US005655471A

United States Patent [19]

Tajima

[11] Patent Number: 5,655,471

[45] Date of Patent: Aug. 12, 1997

[54] THREAD TAKE-UP LEVER GUARD IN SEWING MACHINE

[75] Inventor: Ikuo Tajima, Kasugai, Japan

[73] Assignee: Tokai Industrial Sewing Machine Co., Ltd., Aichi, Japan

[21] Appl. No.: 651,729

[22] Filed: May 22, 1996

[30] Foreign Application Priority Data

Sep. 22, 1995 [JP] Japan ..... 7-269319

[51] Int. Cl.[6] ..... D05B 83/00; D05B 49/00; D05C 11/00

[52] U.S. Cl. ..... 112/261; 112/241; 112/98; 112/163; 112/302

[58] Field of Search ..... 112/57, 58, 96, 112/98, 99, 100, 163, 241–250, 225, 302, 80.43, 258, 259, 261, 253

[56] References Cited

U.S. PATENT DOCUMENTS

| | | | |
|---|---|---|---|
| 1,298,413 | 3/1919 | Sivokon | 112/261 |
| 2,254,050 | 8/1941 | Stadub | 112/261 |
| 3,782,312 | 1/1974 | Kasuga | 112/241 |
| 4,531,467 | 7/1985 | Golia, Jr. et al. | 112/163 X |
| 4,655,152 | 4/1987 | Angele et al. | 112/253 |
| 5,390,613 | 2/1995 | Shibata | 112/163 X |

FOREIGN PATENT DOCUMENTS

| | | | |
|---|---|---|---|
| 505422 | 5/1939 | United Kingdom | 112/261 |

*Primary Examiner*—Ismael Izaguirre
*Attorney, Agent, or Firm*—Koda and Androlia

[57] ABSTRACT

A thread take-up lever guard in a multi-needle sewing machine provided with a support disposed on the front surface of a head, a plurality of needle bars each having a needle attached to the lower end, and a plurality of thread take-up levers disposed to oppose the needle bars respectively and protruded from the support to be able to oscillate vertically. The thread take-up lever guard prevents a needle thread carried on a selected thread take-up lever from being caught by an adjacent thread take-up lever assuming a standing posture or is tangled with another needle thread carried on the standing thread take-up lever. The thread take-up lever guard comprises a separator disposed on the support such that every adjacent two thread take-up levers may be isolated from each other over a predetermined range of routes along which the take-up levers reciprocate. The separators are notched at positions where thread holes of the thread take-up levers are situated when the thread take-up levers are assuming predetermined standing postures.

2 Claims, 5 Drawing Sheets

THREAD TAKE-UP LEVER GUARD IN SEWING MACHINE

BACKGROUND OF THE INVENTION

1. Field of the Invention

The present invention relates to a thread take-up lever guard in a sewing machine, particularly to a thread take-up lever guard in a multi-needle sewing machine.

2. Description of the Related Art

There is known a multi-needle sewing machine having a constitution in which a support supporting thereon a plurality of needle bars and a plurality of needle take-up levers disposed to oppose the needle bars respectively is slidably mounted on an arm provided with mechanisms for driving the needle bars and the thread take-up levers. In such type of multi-needle sewing machine, the desired needle bar and needle take-up lever are selected by sliding the support, and only the thus selected needle bar and needle take-up lever are driven by the driving mechanisms in the arm, whereas the other needle bars and thread take-up levers which were not selected are maintained at predetermined standing postures.

In the multi-needle sewing machine having the above-described constitution, it can happen, while the selected needle bar and thread take-up lever are driven, that a needle thread carried on the selected thread take-up lever in reciprocating motion is caught by an adjacent thread take-up lever assuming the standing posture or is tangled with another needle thread carr adjacent standing thread take-up lever. In such cases, there occurs inconveniences which can be pointed out that the needle thread is broken, and if not so, tightness of stitches is affected to cause thread tension defect.

The present invention is proposed in view of the problems described above and with a view to solving them successfully, and it is an objective of the present invention to provide a thread take-up lever guard in a sewing machine, which can effectively prevent a needle thread carried on an in-service thread take-up lever from interfering with other thread take-up levers assuming the standing postures or other needle threads carried on them.

SUMMARY OF THE INVENTION

In order to overcome the problems described above and to attain the intended object, the present invention provides a thread take-up lever guard in a multi-needle sewing machine provided with a support disposed on the front surface of a head; a plurality of needle bars, provided ascendably in the support, each having a needle attached to the lower end; and a plurality of thread take-up levers disposed to oppose the needle bars respectively and protruded from the support to be able to oscillate vertically; wherein the thread take-up lever guard comprises a separator disposed on the support such that every adjacent two thread take-up levers may be isolated from each other over a predetermined range of routes along which the take-up levers reciprocate.

The separators in the thread take-up lever guard are more preferably notched at positions where thread holes of the thread take-up levers are situated when the thread take-up levers are assuming predetermined standing postures.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

DETAILED DESCRIPTION OF THE PREFERRED EMBODIMENTS

Figure 1:
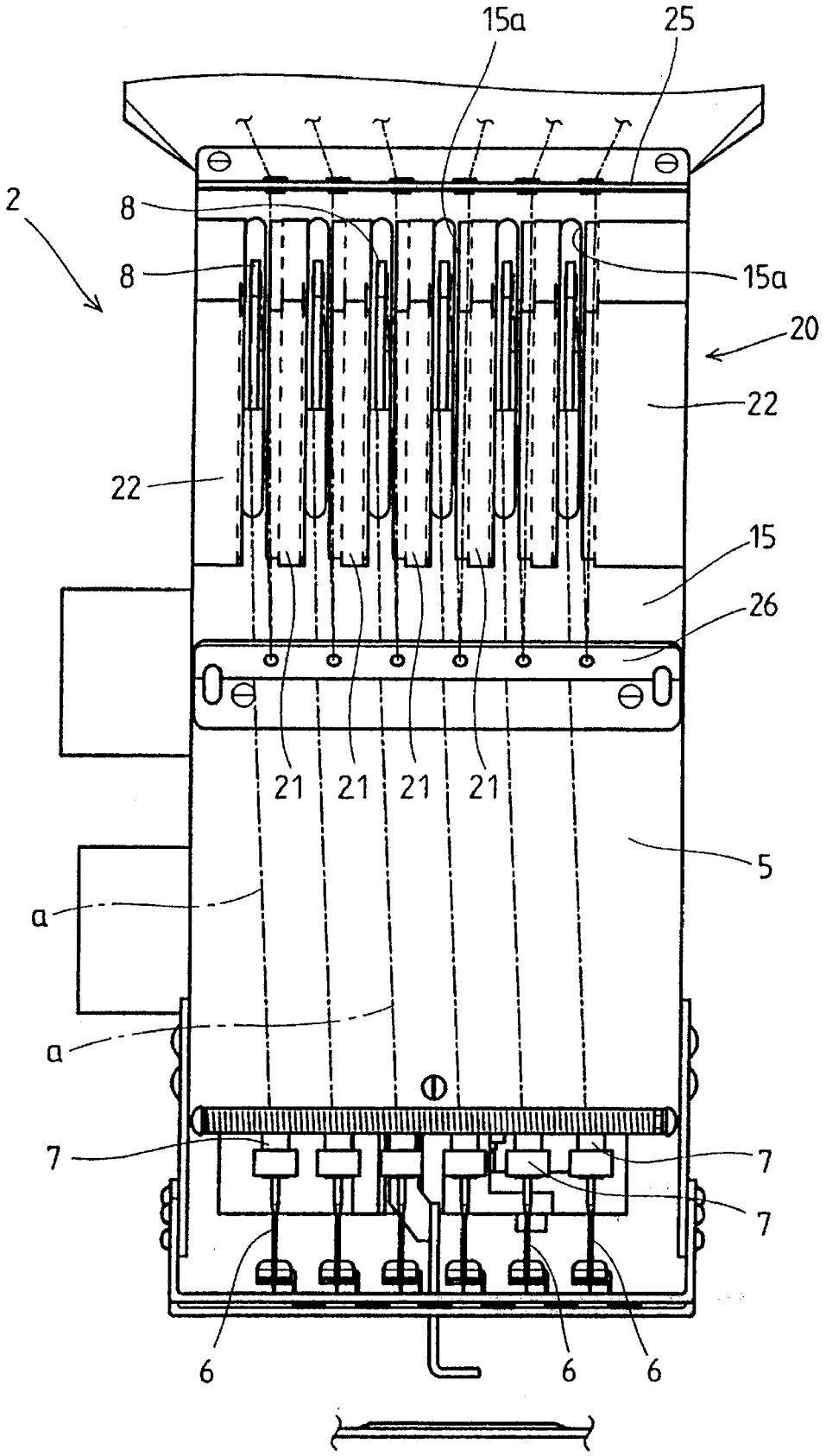
FIG. 1 shows in front view a head of a sewing machine to which the present invention is applied.
Figure 2:
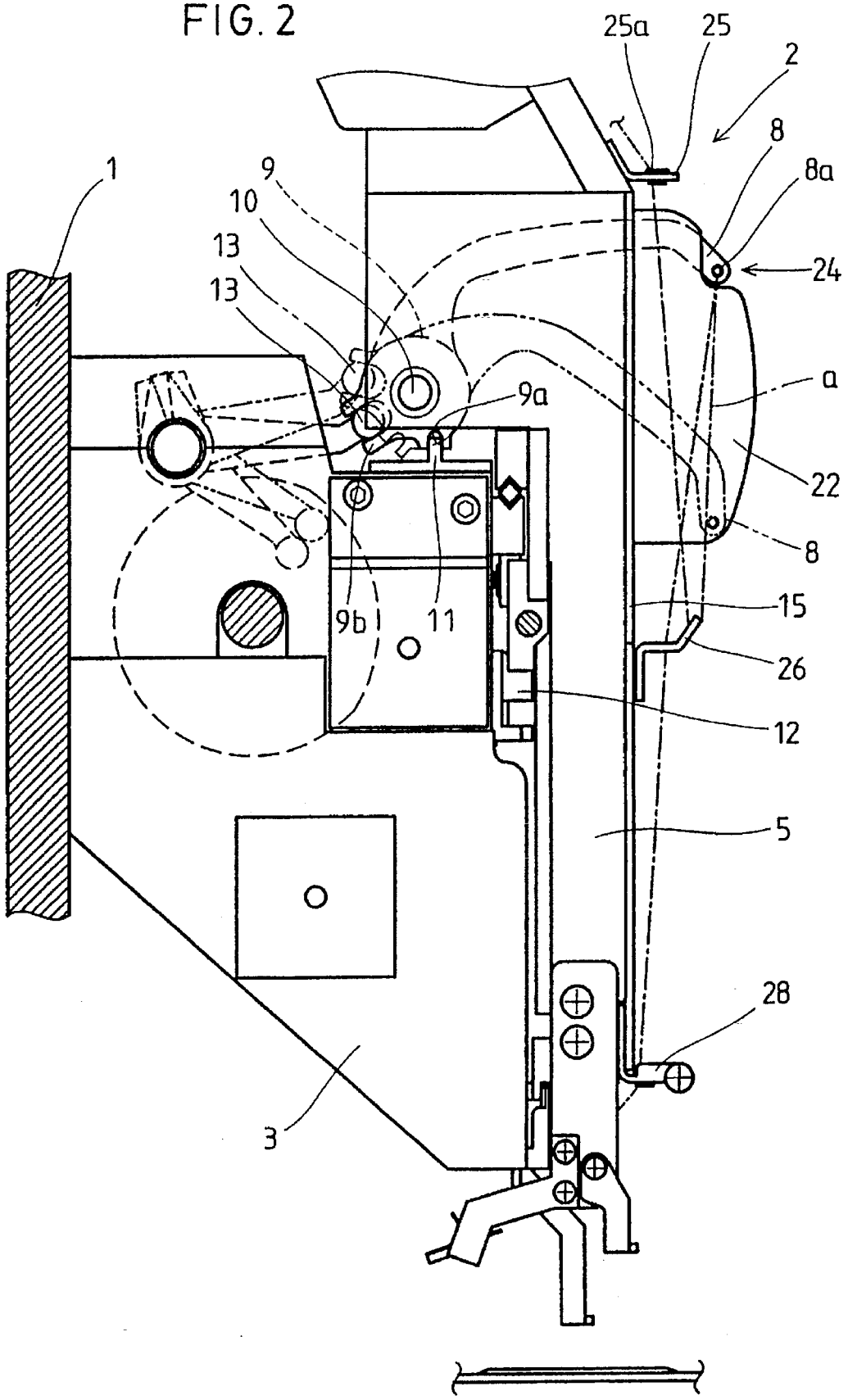
FIG. 2 shows a partially see-through side view of the head shown in FIG. 1.

Next, the thread take-up lever guard according to the present invention will be described below by way of preferred embodiments referring to the attached drawings. FIG. 1 shows a front view of a head in a multi-needle sewing machine, and FIG. 2 shows a side view of the head shown in FIG. 1. As shown in FIG. 2, the head 2 consists of an arm 3 fixed to the front surface of a machine frame 1 to extend horizontally therefrom and a support case 5 applied to the front surface of the arm 3 to be slidable crosswise. In this support case 5 are supported a plurality of needle bars 7 (six in this embodiment), each having a needle 6 attached to the lower end, parallelwise with predetermined intervals in the sliding direction of the support case 5. Further, thread take-up levers 8 (six in this embodiment) are also supported in the support case 5 to oppose the needle bars 7 respectively and to be able to oscillate vertically with bosses 9 thereof being fitted on a support shaft 10. Each thread take-up lever 8 has an engaging groove **9*a* defined on the circumference of the boss 9, and the thread take-up lever 8 is designed to be maintained substantially at the top dead point by engaging the engaging groove 9*a* slidably with a thread take-up lever rail 11 fixed horizontally on the upper end face of the arm 3**.

The support case 5 is designed to be slid via a slide control mechanism (not shown) so as to select a desired needle bar 7 to be in service. The arm 3 contains a driving element 12 which is driven by a needle bar driving mechanism to reciprocate vertically, and the needle bar 7 selected by sliding the support case 5 is engaged with this driving element 12 to be reciprocated vertically. Further, the arm 3 contains a driving roller 13 which is driven by a thread take-up lever driving mechanism to oscillate vertically, and the thread take-up lever 8 opposing the selected needle bar 7 is reciprocated vertically by engaging a forked portion **9*b* formed on the boss 9 thereof with the driving roller 13. Incidentally, the thread take-up lever 8 indicated by the two-dot and chain line shown in FIG. 2 locates at the bottom dead point. It should be noted here that the engaging groove 9*a* formed on the boss 9 of the selected thread take-up lever 8 is situated to oppose one of notches formed on the thread take-up lever rail 11 to assume a free state and to be able to oscillate. Meanwhile, the other needle bars 7 which were not selected are maintained at the top dead points respectively; whereas the thread take-up levers 8** which were not selected are also maintained substantially at the top dead points respectively as indicated by the chain line.

Figure 3:
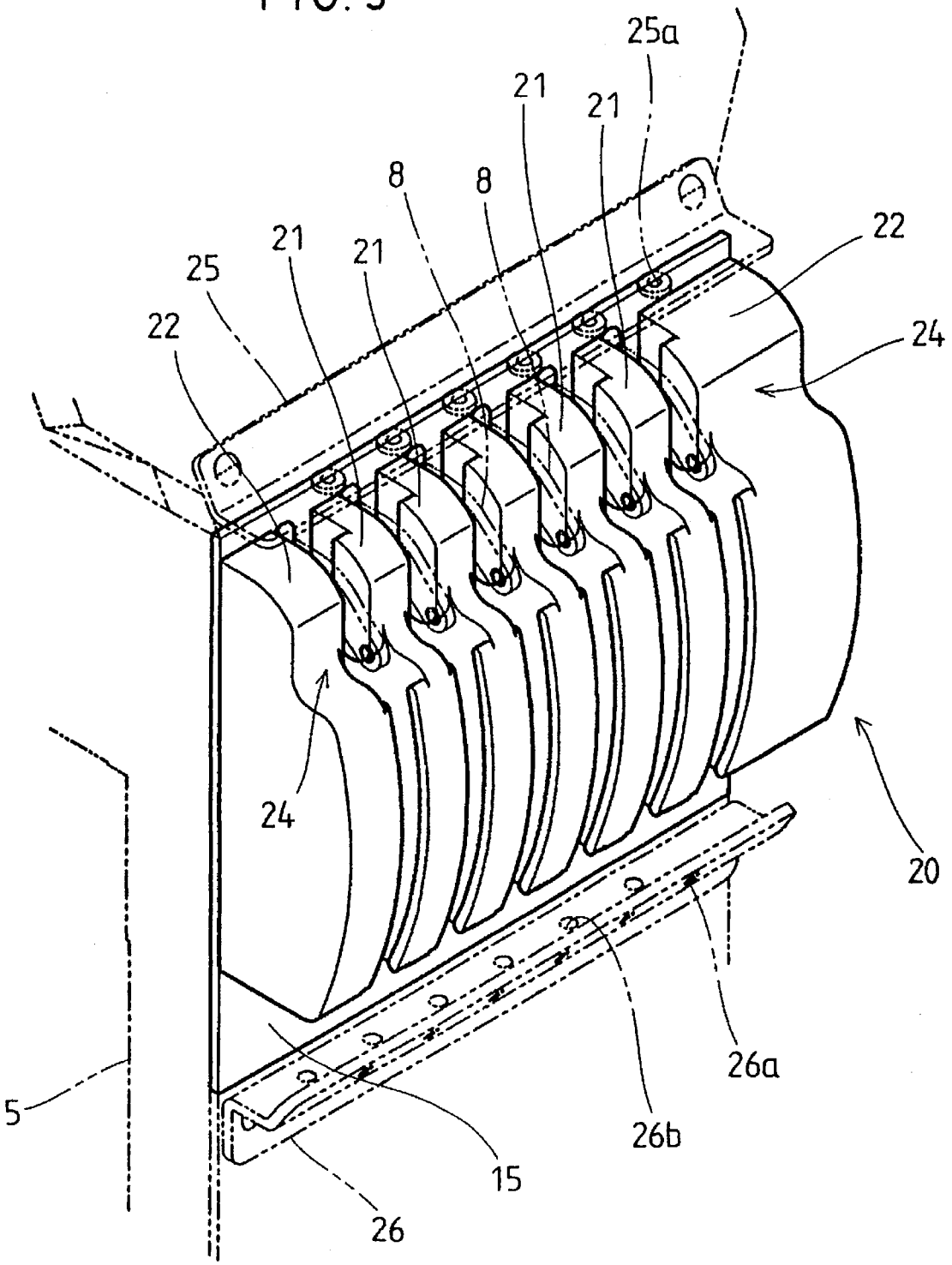
FIG. 3 shows a perspective view of the thread take-up lever guard to be attached to the head.

The distal ends of the thread take-up levers 8 protrude forward through corresponding vertical slits **15*a* defined in a front cover 15 attached to the front surface of the support case 5, respectively. A thread take-up lever guard 20 for protecting the thread take-up levers 8 is attached to the front surface of the front cover 15. This thread take-up lever guard 20, particularly as shown in FIG. 3, basically consists of separators 21 interposed between every adjacent two thread take-up levers 8 and shields 22 disposed on the outer sides of the outermost thread take-up levers 8. The separators 21 and the shields 22 are preferably of synthetic resin molded products, and they have a height and a depth so as to cover entirely the strokes of the distal end portions of the thread take-up levers 8 protruding from the front surface of the front cover 15. The separators 21 are adhered, for example, with an adhesive to the front surface of the front cover 15 with the rear edges of the separators 21 being abutted against the side edges of the corresponding slits 15***a*, respectively. Meanwhile, the shields 22 to be situated at the outermost positions are different from the separators 21 in the thickness and in the outer end face profile for design's sake and are also adhered with an adhesive to the front surface of the front cover 15 with the same interval as between every adjacent two separators 21 being secured between each shield 22 and the adjacent separator 21.

Figure 4:
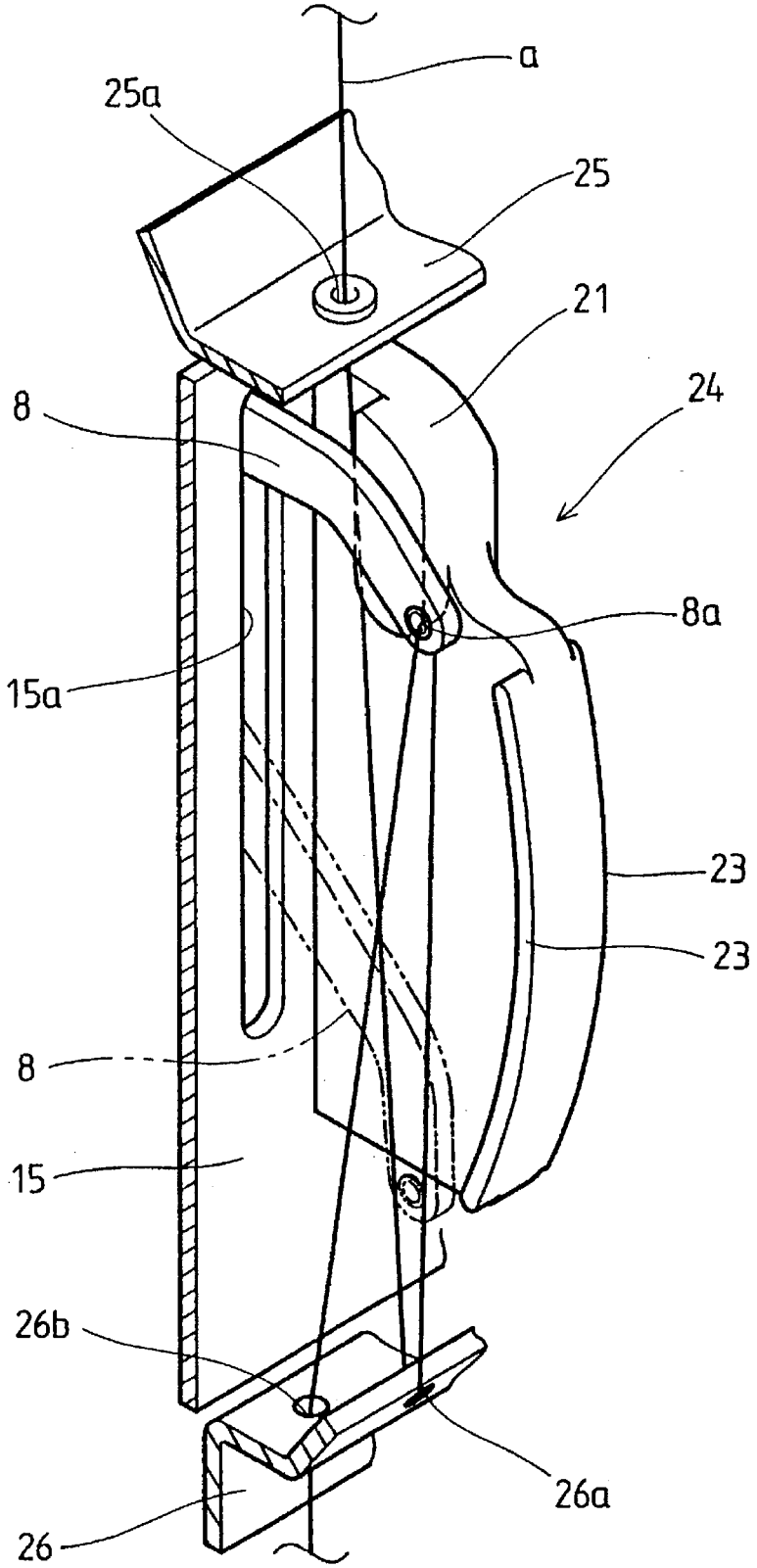
FIG. 4 shows a perspective view explaining the fitting state of a separator in the thread take-up lever guard.
Figure 5:
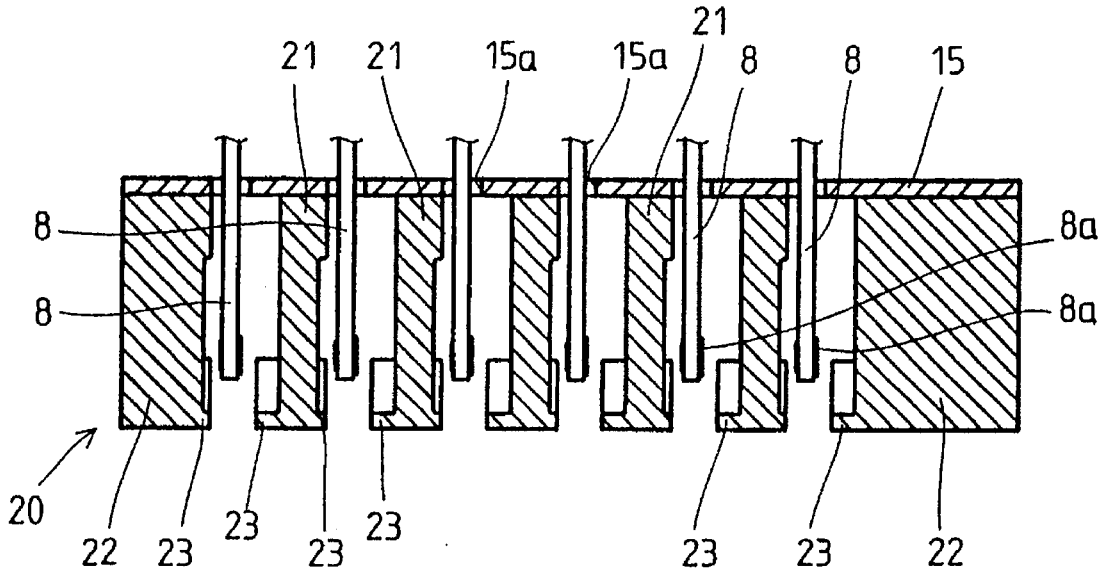
FIG. 5 shows a horizontal cross-sectional view of the thread take-up levers shown in FIG. 3.
Figure 6:
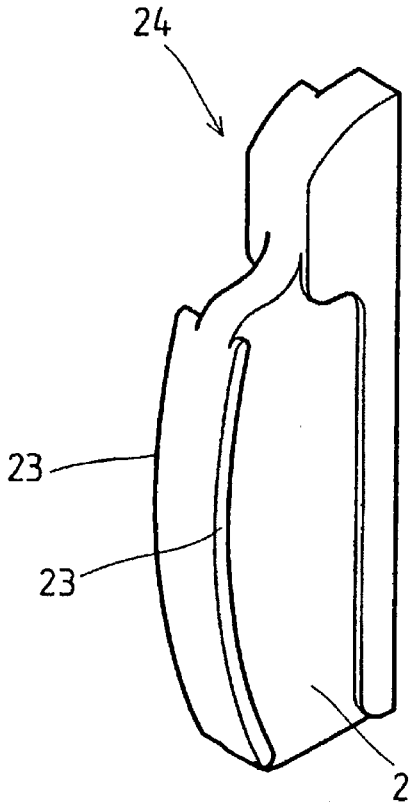
FIG. 6 is a perspective view of the separator shown in FIG. 4.
Figure 6:
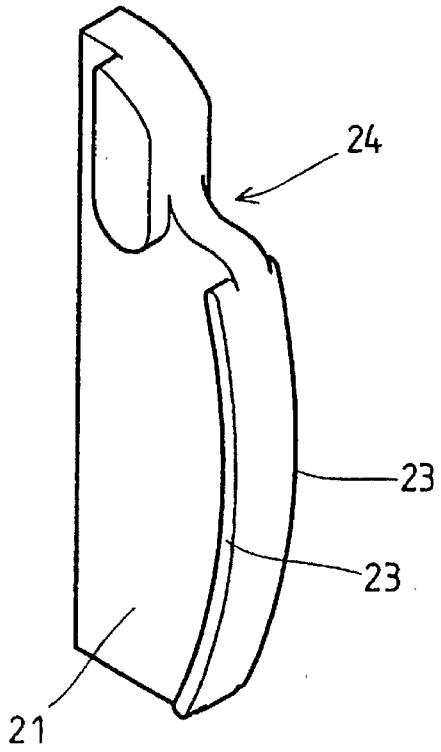

A predetermined shape of notches 24 are formed at the upper front portions of the separators 21 and of shields 22, respectively. These notches 24, as clearly shown in FIG. 2, are directed to open thread holes 8*a* of the respective thread take-up levers 8 in the horizontal direction, when the sewing machine is not in operation and the thread take-up levers 8 are locating substantially at the top dead points, respectively. Further, as shown in FIG. 4, the separators 21 and shields 22 each have a flange or flanges 23 extended crosswise from the front edges thereof, respectively, so as to reduce the front opening width between the adjacent separators 21 or between the separator 21 and the shield 22.

Next, actions of the thread take-up lever guard 20 according to the embodiment of the present invention will be described. To describe first threading with respect to a thread take-up lever 8, as shown in FIGS. 2 and 4, a needle thread a is passed through a thread hole 25*a* of an upper thread handling area 25 locating upstream the thread take-up lever 8 and then through a thread hole 26*a* of an intermediate thread handling area 26 locating downstream the thread take-up lever 8. Subsequently, after the needle thread a is passed through a thread hole 8*a* of the thread take-up lever 8, it is passed through another thread hole 26*b* of the intermediate thread handling area 26 and then through a thread hole (not shown) of a needle 6 via a lower thread handling area 28 locating further downstream. In this threading procedures, since each side of the thread take-up lever 8 locating substantially at the top dead point is open as described above, threading to the thread hole 8*a* of the thread take-up lever 8 can be facilitated. Further, the slits formed between every adjacent two separators 21 or between the separator 21 and the shield 22 facilitates the above-described series of threading procedures.

While the sewing machine is in operation, a selected thread take-up lever 8 is reciprocated vertically to shake a needle thread a passed through the thread hole 8*a* thereof, so that the portion of the needle thread a present between the upper thread handling area 25 and the intermediate thread handling area 26 is vigorously swung blindly. However, the presence of separators 21 (or shield 22) on each side of the thread take-up lever 8 can avoid interference of the needle thread a with the adjacent thread take-up levers 8 or threads carried on them, and thus occurrence of thread breakage or irregularity in stitches can be securely prevented. Incidentally, since the front opening width between the separators 21 and between the separator 21 and the shield 22 are reduced by the flanges 23 formed at the front surface of the separators 21 and the shields 22, fingers of operators, if inadvertently approached to the thread take-up lever 8 in operation, can be prevented from intruding into the openings, securing safety of the operator.

While the separators 21, shields 22 and front cover 15 are molded individually, they may be molded integrally. Meanwhile, the flanges 23 formed on the separators 21 and shields 22 are not essential elements and can be omitted if the opening width between the separators 21 axe narrowed. Further, shields 22 are employed on each side for design's sake, they may be replaced with separators 21.

Although only a few embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope of the appended claims.

What is claimed is:

1. A thread take-up lever guard in a multi-needle sewing machine provided with a support and a support cover with a plurality of slits disposed on the front surface of a head; a plurality of needle bars, provided ascendably in said support, each having a needle attached to the lower end; and a plurality of thread take-up levers disposed to oppose said needle bars respectively and protruded from said plurality of slits of said support cover to be able to oscillate vertically;

wherein said thread take-up lever guard comprises a plurality of separators mounted adjacent to the plurality of slits such that every adjacent two thread take-up levers and threads are isolated from each other over a predetermined range of routes along which said take-up levers reciprocate.

2. The thread take-up lever guard according to claim 1, wherein each of said plurality of separators is notched at positions where thread holes of said thread take-up levers are situated when said thread take-up levers are assuming predetermined standing postures.

* * * * *